US006364613B1

(12) United States Patent
Deallenbach et al.

(10) Patent No.: US 6,364,613 B1
(45) Date of Patent: Apr. 2, 2002

(54) HOLLOW FINGER DOVETAIL PIN AND METHOD OF BUCKET ATTACHMENT USING THE SAME

(75) Inventors: Robert Edward Deallenbach, Schenectady; Michael Earl Montgomery, Niskayuna, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/639,046

(22) Filed: Aug. 15, 2000

(51) Int. Cl.[7] ..... F01D 5/30

(52) U.S. Cl. ..... 416/220 R; 416/204 A; 416/244 A; 416/248; 415/115

(58) Field of Search ..... 415/115; 416/97 R, 416/220 R, 204 A, 244 R, 244 A, 248, 217; 29/889.21

(56) References Cited

U.S. PATENT DOCUMENTS

| | | | | |
|---|---|---|---|---|
| 4,047,840 A | | 9/1977 | Ravenhall | |
| 4,265,595 A | | 5/1981 | Bucy, Jr. | |
| 4,460,316 A | * | 7/1984 | Partington | 416/217 |
| 4,509,265 A | | 4/1985 | Donaldson | |
| 4,551,063 A | * | 11/1985 | Raschke et al. | 415/115 |
| 5,062,769 A | * | 11/1991 | Ortolano | 416/217 |
| 5,368,444 A | | 11/1994 | Anderson | |
| 5,388,962 A | * | 2/1995 | Wygle et al. | 416/95 |
| 5,713,721 A | | 2/1998 | Glynn | |

FOREIGN PATENT DOCUMENTS

JP 54130711 A * 10/1979

* cited by examiner

*Primary Examiner*—Edward K. Look
*Assistant Examiner*—Ninh Nguyen
(74) *Attorney, Agent, or Firm*—Nixon & Vanderhye PC

(57) ABSTRACT

A unique finger dovetail pin configuration is provided to attach the buckets of a control stage of a turbine to the rotor wheel. More particularly, as an embodiment of the invention, a bore is provided through the center of the pin to form a hollow pin. The primary benefit of providing a hollow pin configuration is that a passage is defined for the axial flow of steam through the dovetail attachment. For a control stage bucket, this axial flow is desirable to minimize the leakage of steam from the space between the first stage nozzle and bucket, and to provide a source of cooling flow to the forward side of the turbine wheel. Another benefit of the hollow pin is to facilitate removal of the pins when servicing of the high pressure rotor is required.

11 Claims, 3 Drawing Sheets

HOLLOW FINGER DOVETAIL PIN AND METHOD OF BUCKET ATTACHMENT USING THE SAME

BACKGROUND OF THE INVENTION

Steam turbine buckets applied at the later stages of the low pressure turbine have for many years utilized a finger dovetail configuration to provide attachment of the buckets to the turbine rotor. With this dovetail configuration, the connection between the bucket and wheel dovetail is accomplished using a series of dovetail pins.

A new control stage bucket configuration is being developed for application with "dense pack" steam turbine designs. To provide maximum resistance to the high dynamic stimuli experienced by the control stage bucket, a finger dovetail configuration has been selected for attaching the control stage buckets to the turbine rotor.

BRIEF SUMMARY OF THE INVENTION

To maximize high pressure turbine efficiency, a reverse flow of steam from the aft to the forward side of the control stage turbine wheel is desirable to pressurize a shaft seal located forward of the control stage wheel. When this reverse flow is provided in the design, the sealing steam passes through the control stage buckets and performs useful work prior to being fed into the shaft seal. This reverse flow of steam is typically accomplished by providing steam balance holes either through the turbine wheel, or through the bucket platforms. In combination with the steam balance holes, a root seal is provided at the admission side of the control stage bucket to discourage flow from the nozzle-bucket space into the forward wheel space. Also, a small level of negative root reaction may be applied to the stage design to increase the pressure at the aft side of the turbine wheel to promote additional reverse flow through the wheel. Alternatively, if this reverse flow is not provided, the sealing steam must be fed from the space between the first stage nozzle and bucket. Extracting the steam from this location results in a loss in turbine output and efficiency since the sealing steam flows directly from the nozzle into the shaft seal without extracting any useful work.

Due to the geometry and operating stress limitations, use of a conventional steam balance hole arrangement is not compatible with the new finger dovetail control stage configuration. To overcome this limitation, the invention provides a unique, hollow dovetail pin configuration to be applied to this control stage application. More particularly, as an embodiment of the invention, a bore or passage is provided through the center of the pin to form a hollow pin. The pin outside and bore dimensions are selected to provide the required steam flow area while meeting all of the pin structural requirements.

Another important reason for the reverse flow of steam from the aft to the forward side of the control stage wheel is to provide a flow of cooling steam (i.e., lower temperature steam) to the forward side of the wheel. The basic mechanism is that the steam on the aft side of the wheel, having had work extracted by the first stage buckets, is at a lower temperature than the steam in the first stage nozzle to bucket space. The resulting reduction in component operating temperature improves material strength levels within the affected rotor body and dovetail regions. The hollow pin concept of the invention provides the benefits of this cooling steam to the new control stage design.

At the operating temperatures of the control stage bucket, which are in the vicinity of 1000 degrees F., oxidation of the component materials will occur. Experience and testing show that this build-up of oxide will cause dovetail pins to become trapped in the dovetail pin holes, thus making it difficult to remove the pins when servicing is required on the rotor assembly. Use of the hollow dovetail pins of the invention is expected to reduce the effort involved in removing or extracting the dovetail pins, and to reduce the potential for damaging the dovetail pin holes during the removal/extraction process. In one possible extraction method, the bore in the pins would serve as a pilot hole for extracting the pins using a piloted reamer. In another method, coolant would be applied within the bore of the dovetail pins to cause the pins to contract in diameter to a point where the pins would break free from the oxide build-up and then could be removed intact. Yet another possible use of the hole is to thread an extraction device into the pin bore so that appropriate dis-assembly forces could be applied to the pin.

In other potential future applications of a finger dovetail bucket, the hollow pin concept could be used to provide steam balance holes for the purpose of reducing the pressure drop across the turbine wheel with a resulting reduction in the axial thrust level on the rotor. Also, the hollow pin concept could be used to control secondary flows in the turbine so as to reduce interactions between the primary turbine steam flow and secondary flows within the wheelspace and shaft seal regions. Such control is desirable to obtain optimum levels of turbine efficiency.

As is evident from the foregoing, the use of hollow finger dovetail pins embodying the invention for a finger dovetail control stage bucket design maximizes turbine efficiency by feeding the forward shaft seal with steam from the aft side of the control stage wheel, provides a flow of cooling steam to the forward side of the control stage wheel and minimizes the effort involved and potential secondary damage associated with removing or extracting finger dovetail pins after a period of turbine operation.

DETAILED DESCRIPTION OF THE INVENTION

Figure 1:
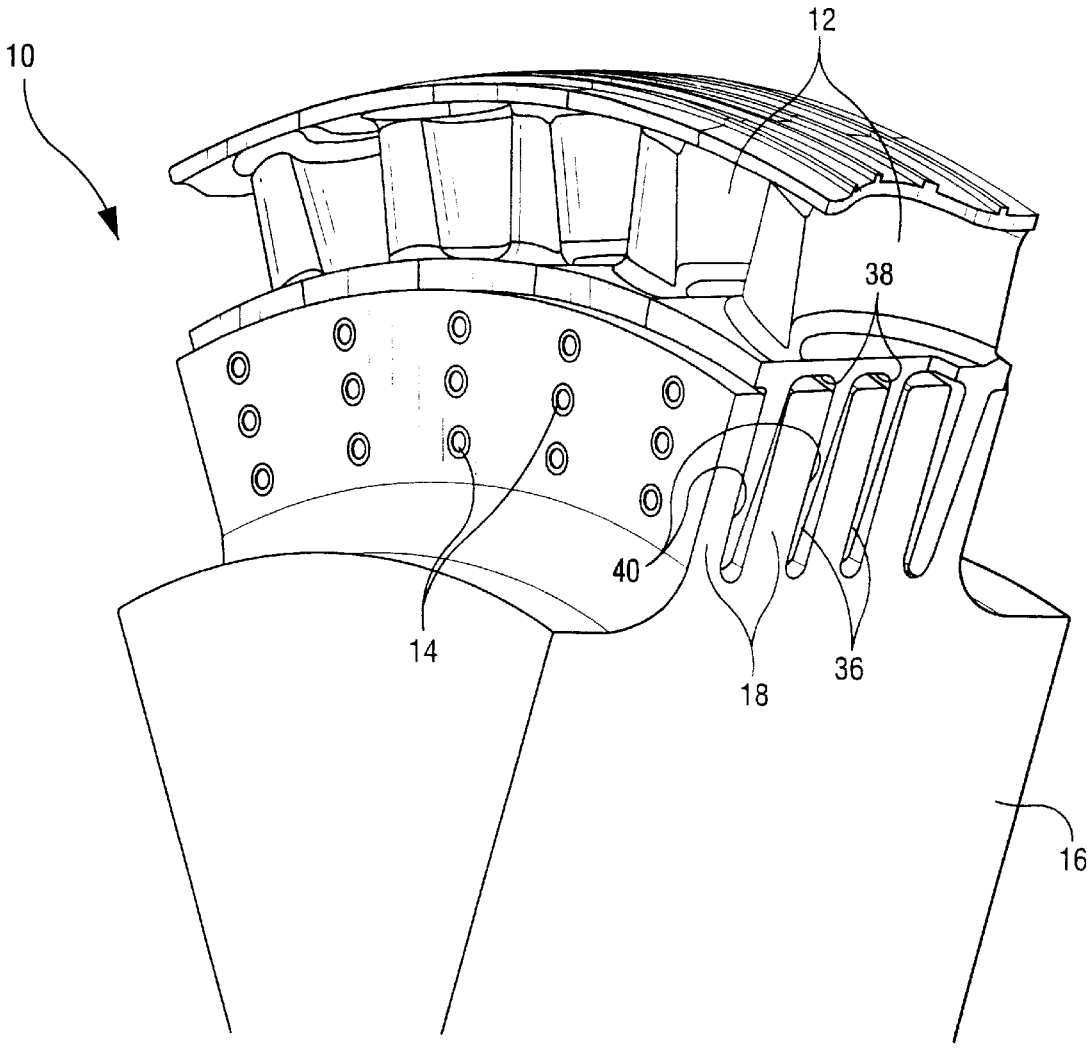
FIG. 1 is a cutaway perspective view schematically illustrating a finger dovetail configuration providing an attachment of control stage buckets to the turbine rotor wheel and secured with hollow finger dovetail pins as an embodiment of the invention.

In FIG. 1, a sector 10 of the control stage wheel is shown in the assembled condition. The assembly includes the control stage buckets 12, the hollow finger dovetail pins 14 embodying the invention and the turbine rotor wheel 16. More specifically, each bucket 12 has a plurality of bucket dovetail projections 36 with a plurality of bucket dovetail slots 38 defined therebetween, and the wheel has a plurality of generally radial wheel dovetail projections 18 with a plurality of dovetail slots 40 defined therebetween.

Figure 2:
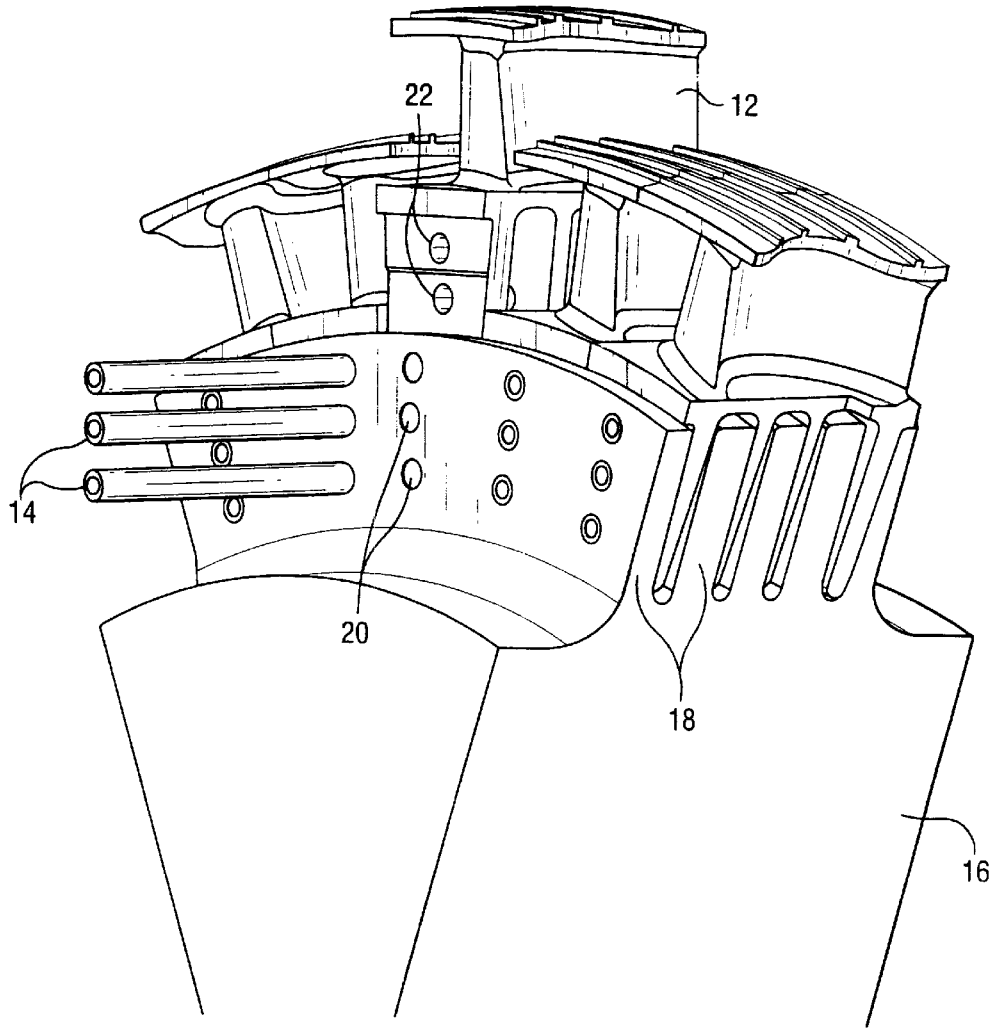
FIG. 2 is a perspective view similar to FIG. 1, showing a set of hollow finger dovetail pins removed to allow engagement/disengagement of a bucket from the rotor wheel.

FIG. 2 shows the sector 10 of FIG. 1 with one bucket 12 being inserted radially to be engaged with the wheel, so that the bucket dovetail projections 36 are received within respective wheel dovetail slots 40. After assembly of the bucket 12 to the rotor wheel 16, a plurality of dovetail pins 14 are received through respective dovetail pin receiving bores defined by aligned apertures 20, 22 defined in the bucket dovetail projections 36 and the wheel dovetail projections 18, respectively, to complete the connection between the bucket and dovetails.

Figure 3:
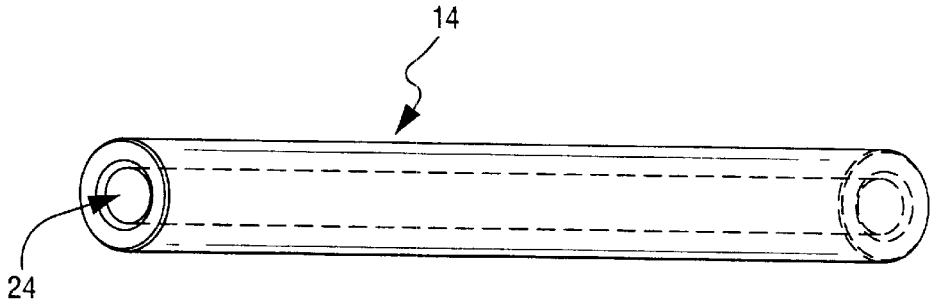
FIG. 3 is a schematic perspective view of a hollow finger dovetail pin embodying the invention.

An exemplary hollow finger dovetail pin 14 is shown in FIG. 3. A bore or passage 24 is defined through the center of the pin 14. As noted above, the outside and the inside dimensions of the finger dovetail pin are selected to maintain the bucket, wheel, and pin operating stresses within determined, allowed stresses. Suitable dimensional determinations may be made by routine experimentation. In the current application, three dovetail pins 14 are preferably applied to each bucket in the row. However, it is contemplated that anywhere from two to six pins could be provided per bucket and at least one of those pins is hollow for fluid flow therethrough. Therefore, the illustrated embodiment is not to be considered limiting in this respect.

Figure 4:
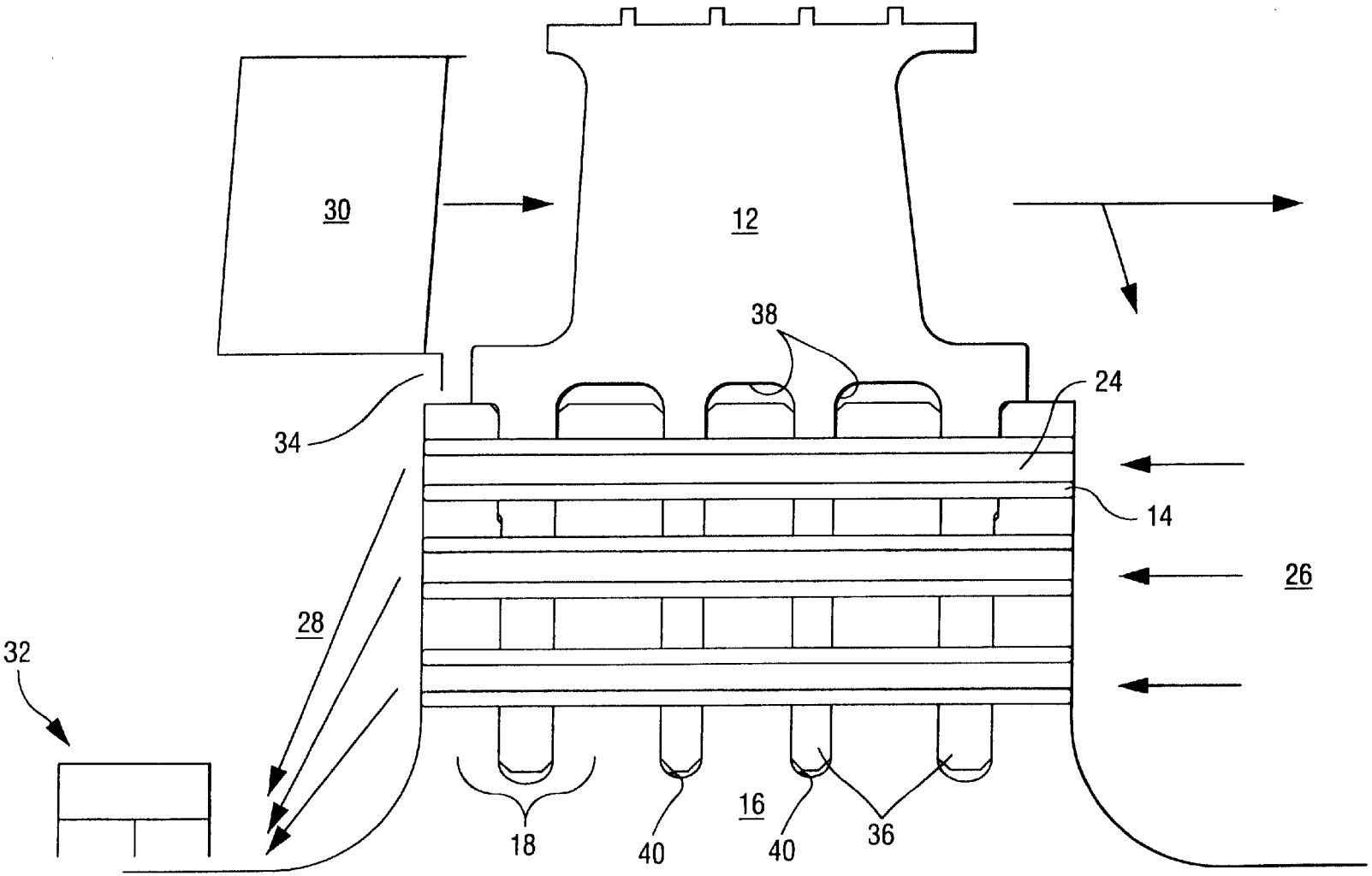
FIG. 4 is a schematic cross-sectional view showing the steam balance/cooling hole function of the hollow dovetail pins embodying the invention.

FIG. 4 schematically illustrates the function of the pins 14 with respect to providing a reverse flow of steam from the aft side 26 to the forward side 28 of the control stage wheel. High pressure steam is accelerated through the first stage nozzle 30 and directed to the bucket 12 where work is extracted to produce turbine power. The aerodynamic parameters of this stage are set such that the pressure on the aft side 26 of the wheel is slightly higher than the pressure on the forward side 28 of the wheel 16. The total area of the bores or passages 24, which is defined by the area of each bore 24 times the number of hollow pins 14 per bucket 12 times the number of buckets in a row, is selected to produce a sufficient flow to provide most or all of the steam required to feed the forward shaft seal 32. A root seal 34 is provided on the forward side of the wheel 16 to discourage the flow of steam from the nozzle/bucket space into the forward wheel space. The steam on the aft side 26 of the wheel is also at a lower temperature than the steam in the nozzle to bucket space and thus the axial steam flow through the bucket via the hollow pins provides a source for cooling the forward side of the rotor and dovetail.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An assembly for locking a generally radially extending bucket to a wheel of a rotor of a turbine, the bucket having a plurality of bucket dovetail projections with a plurality of bucket dovetail slots defined therebetween, and the wheel having a plurality of generally radial wheel dovetail projections with a plurality of dovetail slots defined therebetween, the bucket dovetail projections being received within respective wheel dovetail slots, and a plurality of dovetail pins being received through respective dovetail pin bores defined by aligned apertures defined in said bucket dovetail projections and said wheel dovetail projections, at least one said pin having a bore defined therethrough whereby said pin is hollow and defines a flow path for fluid flow therethrough from one axial side of the wheel to another, said bore of said pin being unobstructed during operation of said turbine so that fluid can flow therethrough from said one axial side of the wheel to the other during rotation of the rotor.

2. An assembly as in claim 1, wherein there are at least three dovetail pins for securing said bucket with respect to said wheel.

3. An assembly as in claim 1, wherein there are a plurality of buckets disposed side by side circumferentially of the rotor, each having respective dovetail projections and wherein said dovetail slots of said wheel are defined substantially continuously about the circumference thereof.

4. An assembly as in claim 1, wherein each said dovetail pin is hollow for fluid flow therethrough.

5. A control stage of a turbine comprising a plurality of generally radially extending buckets secured to a wheel of a rotor of a turbine, said buckets being secured generally side-by-side about the circumference of said wheel, each said bucket having a plurality of bucket dovetail projections with a plurality of bucket dovetail slots defined therebetween, and the wheel having a plurality of generally radial wheel dovetail projections with a plurality of dovetail slots defined therebetween, said wheel dovetail slots extending generally circumferentially of said wheel, the dovetail projections of said buckets being received within respective wheel dovetail slots, and a plurality of dovetail pins being received through respective dovetail pin bores defined by aligned apertures defined in said wheel dovetail projections and said dovetail projections of said buckets, respectively, so that a plurality of pins secure each said bucket to said wheel, at least one said pin of each said bucket having a bore defined therethrough whereby said pin is hollow and defines a flow path for fluid flow therethrough from one axial side of the wheel to another, said bore of said pin being unobstructed during operation of said turbine so that fluid can flow therethrough from said one axial side of the wheel to the other during rotation of the rotor.

6. An assembly as in claim 5, wherein there are at least three dovetail pins for securing each said bucket with respect to said wheel.

7. An assembly as in claim 5, wherein each said dovetail pin is hollow for fluid flow therethrough.

8. A method of securing a bucket with respect to a wheel of a rotor, the bucket having a plurality of bucket dovetail projections with a plurality of bucket dovetail slots defined therebetween and the wheel having a plurality of generally radial wheel dovetail projections with a plurality of dovetail slots defined therebetween, the method comprising:

assembling the bucket to the wheel by aligning the bucket dovetail projections with respective wheel dovetail slots, and radially displacing the bucket so that the bucket dovetail projections are received in the wheel dovetail slots; and inserting a plurality of dovetail pins through respective dovetail pin bores defined by aligned dovetail pin apertures defined in said bucket dovetail projections and said wheel dovetail projections, at least one said pin having a bore defined therethrough whereby said pin is hollow and defines a flow path for fluid flow therethrough from one axial side of the assembled bucket and wheel to another, and wherein said flow path is maintained unobstructed during rotation of the rotor thereby allowing fluid flow therethrough from said one axial side of the assembled bucket and wheel to the other.

9. A method as in claim 8, wherein said inserting step comprises inserting at least three dovetail pins to securing said bucket with respect to said wheel.

10. A method as in claim 8, wherein there are a plurality of buckets disposed side by side circumferentially of the rotor, each having respective dovetail projections and wherein said dovetail slots of said wheel are defined substantially continuously about the circumference thereof.

11. A method as in claim 8, wherein each said dovetail pins is hollow for fluid flow therethrough.

* * * * *